US006807837B1

(12) United States Patent
Alexoff

(10) Patent No.: US 6,807,837 B1
(45) Date of Patent: Oct. 26, 2004

(54) METHOD AND APPARATUS FOR PRODUCING VARIABLE WALL THICKNESS TUBES AND HOLLOW SHAFTS

(76) Inventor: Randall L. Alexoff, 5 Windemere Pl., Poland, OH (US) 44514

( * ) Notice: Subject to any disclaimer, the term of this patent is extended or adjusted under 35 U.S.C. 154(b) by 0 days.

(21) Appl. No.: 10/397,983

(22) Filed: Mar. 26, 2003

(51) Int. Cl.[7] ..... B21D 1/22
(52) U.S. Cl. ..... 72/276; 72/284
(58) Field of Search ..... 72/284, 283, 274, 72/276

(56) References Cited

U.S. PATENT DOCUMENTS

| | | | | |
|---|---|---|---|---|
| 441,927 | A | * 12/1890 | Bray | 72/283 |
| 2,228,301 | A | 1/1941 | Ditzel et al. | |
| 2,270,398 | A | * 1/1942 | Westin | 72/276 |
| 3,546,916 | A | * 12/1970 | Tsutomu et al. | 72/256 |
| 3,572,080 | A | 3/1971 | Alexoff | |
| 4,277,969 | A | 7/1981 | Simon | |
| 4,292,831 | A | 10/1981 | Simon | |
| 4,301,672 | A | 11/1981 | Simon | |
| 4,454,745 | A | 6/1984 | Cudini | |
| 4,487,357 | A | 12/1984 | Simon | |
| 4,616,500 | A | 10/1986 | Alexoff | |
| 4,776,196 | A | 10/1988 | Cudini | |
| 5,205,464 | A | 4/1993 | Simon | |
| 5,213,250 | A | 5/1993 | Simon | |
| 5,241,848 | A | 9/1993 | Simon | |
| 5,320,580 | A | 6/1994 | Simon | |
| 5,487,292 | A | * 1/1996 | Fox | 72/43 |
| 5,511,440 | A | * 4/1996 | Watanabe et al. | 74/492 |
| 5,522,246 | A | 6/1996 | Simon | |
| 6,439,672 | B1 | 8/2002 | Simon | |

FOREIGN PATENT DOCUMENTS

| | | | |
|---|---|---|---|
| DE | 2218667 | * 4/1973 | 72/283 |

* cited by examiner

*Primary Examiner*—Daniel C. Crane
(74) *Attorney, Agent, or Firm*—Robert J. Herberger

(57) ABSTRACT

A method and apparatus for draw forming, from a tubular workpiece, a tube or hollow shaft having a variable wall thickness, using a reducing die without an internal mandrel. A tension force is applied to the workpiece at one axial side of the die and a compression force is applied at the opposite axial side of the die. Changing the relative magnitudes of the tensile and compressive forces produces corresponding changes in the wall thickness as the workpiece passes through the die.

21 Claims, 3 Drawing Sheets

METHOD AND APPARATUS FOR PRODUCING VARIABLE WALL THICKNESS TUBES AND HOLLOW SHAFTS

BACKGROUND OF THE INVENTION

1. Field of the Invention

This invention relates to the field of draw forming material, particularly to the art of forming tubes and hollow shafts having wall thicknesses that vary along the length.

2. Description of the Prior Art

Various cold-drawing techniques for producing tubing and hollow shafts having a wall thickness that is either constant throughout its length or that varies along its length are known. These techniques conventionally use an external reducing die for forming the outer surface of the tube, and an internal mandrel for forming the inner surface and establishing the wall thickness in an annular space located between the die's inner surface and the mandrel's outer surface. U.S. Pat. Nos. 2,228,301 and 4,616,500 describe use of a tension force to draw a workpiece through a reducing die and over a mandrel. This technique works well on large diameter tubing, wherein a removable plug is used to transmit a large pulling or tension force to draw the tube through a die. U.S. Pat. Nos. 4,454,745; 4,487,357; 5,241,848 and 6,439,672 describe use of a compression force to push a mandrel through a workpiece and die.

Tension and compression drawing forces each can cause failure of a workpiece. When the outside diameter of the workpiece is drawn to a small diameter, the tension force that draws the workpiece through a reducing die may cause a tension failure at the small diameter section if the strength of the cross section is insufficient to carry the tensile load. A compression force can cause failure in the region of the die entry opening and the large diameter, where a thin wall is susceptible to local compression instability failure. A method is required to avoid tension and compression failures in a workpiece while drawing tubes, particularly tubes having both large and small diameter length portions.

An aluminum baseball bat is an example of a cold drawn product having a long transition section between large and small diameter zones. The barrel having a diameter of about 2.75 inches, a transition section, and handle having a diameter of about 0.75 inches are drawn from a starting tube having a constant outside diameter and uniform wall thickness using various dies. Variations in the length of the tubes after drawing, which may be about 0.50 inches in a nominal 36.0 inch long tube, are caused by variations in die lubrication, frictional contact of the workpiece with the die, and other process variables. To produce tubes having substantially the same length and smooth surfaces at opposite ends of the transition zone, there is a need to closely control the application of a tension force applied to the part after it is drawn through the reducing die. Unfortunately, it is difficult to control the actuating cylinder that applies the large drawing force with sufficient accuracy so that it also can apply the low magnitude of tension force that would produce smooth transition radii and an accurate overall length of the formed part. There is need to correct this deficiency in conventional equipment used for this purpose.

A tubular workpiece suited for draw forming may be either a seamless tube or a tube rolled from flat stock and having a welded seam running along its length. The seam is often stress relieved after welding to remove residual stresses. Before drawing a welded tube using a mandrel, excess weld material or scarf must be removed from the inner surface. Otherwise the weld material passing over the outer surface of the mandrel under high contact load impairs the drawing operation and requires a larger drawing force than would be necessary if the inner surface were smooth and flush. The increased drawing force increases the possibility of coring the mandrel in the area of the weld.

U.S. Pat. No. 6,311,703 describes an apparatus for scarf flushing or cleaning the inside of welded tubes by directing a high-pressure, high-volume stream of fluid onto the inner surface along the weld seam. The fluid stream removes the extraneous weld material and flushes it out of the tube. However, where the tube length is long and its diameter small, use of this apparatus and the related technique increases the time, difficulty and expense required to draw welded tubes.

An intrusion beam of the type used to strengthen a door of an automotive vehicle against collision damage and occupant injury is an example of a part fabricated from a tubular workpiece that may be either a seamless tube or welded tube. Preferably tubes for intrusion beams would have relatively thin walls in the vicinity of the ends and thicker walls along the tube length between the ends. The thicker wall region increases the structural strength and stiffness of the door beam in the area where the greatest bending stresses would be produced due to impact from a collision. Currently tubes for intrusion beams have a uniform diameter with a constant wall thickness.

It is preferable that a tube drawing method applicable to both unwelded and welded tube be used without changing the process to accommodate the surface condition of the tube and without incurring unnecessary complexity or cost. It is preferable also that variable wall thickness tubes can be drawn by such an improved process or method.

SUMMARY OF THE INVENTION

It is an advantage of this invention that structural failure of a workpiece due to tensile or compressive drawing forces is avoided, particularly while forming tubes having both large and small diameter sections without the use of mandrels.

It is another advantage of this invention that a drawn tube can be produced having relatively thin walls at its ends and thicker walls along a portion of the length between the ends. In the case where a tube having these characteristics is fabricated into a door intrusion beam for a motor vehicle, the resulting advantages include minimized vehicle weight, improved vehicle fuel economy, optimized strength of the passenger compartment door assembly, and enhanced passenger safety.

It is another advantage that a tube having a welded seam on its inner surface be draw-formed without having first to remove the rough inner seam by scarf removal and flushing or other techniques required by conventional methods before passing the workpiece over a forming mandrel.

It is yet another advantage that tubes having walls of differing thickness, constantly changing thickness, or short transition lengths of changing thickness located between zones of uniform thickness can be draw-formed regardless of the surface condition of the inner surface of the workpiece.

It is still another advantage of this invention that outer surface roughness and other discontinuities located near the ends of a tapered transition are removed easily and reliably and replaced by smooth blend radii.

In realizing these advantages, a method for forming from a tubular workpiece a tube or hollow shaft having a wall thickness that varies along its length, includes the steps of positioning relative to the workpiece a reducing die for reducing the outer diameter of the workpiece and establishing the outside diameter of the formed tube, advancing the workpiece through the die by applying to the workpiece a pulling force at a first location and a pushing force at a second location, the first and second locations being on opposite axial sides of the die, and changing the wall thickness of the tube as the workpiece advances through the die by changing the relative magnitudes of the pushing force and pulling force.

An apparatus for forming from a tubular workpiece a tube having a wall thickness that varies along the length of the tube includes a reducing die for reducing the outer diameter of the workpiece and contouring the outer surface of the tube being formed, a first actuating cylinder for producing a pulling force applied to the workpiece at a first location tending to advance the workpiece through the die, and a second actuating cylinder for producing a pushing force applied to the workpiece at a second location tending to advance the workpiece through the die, the first and second locations being on opposite axial sides of the die.

DESCRIPTION OF THE PREFERRED EMBODIMENT

Figure 1:
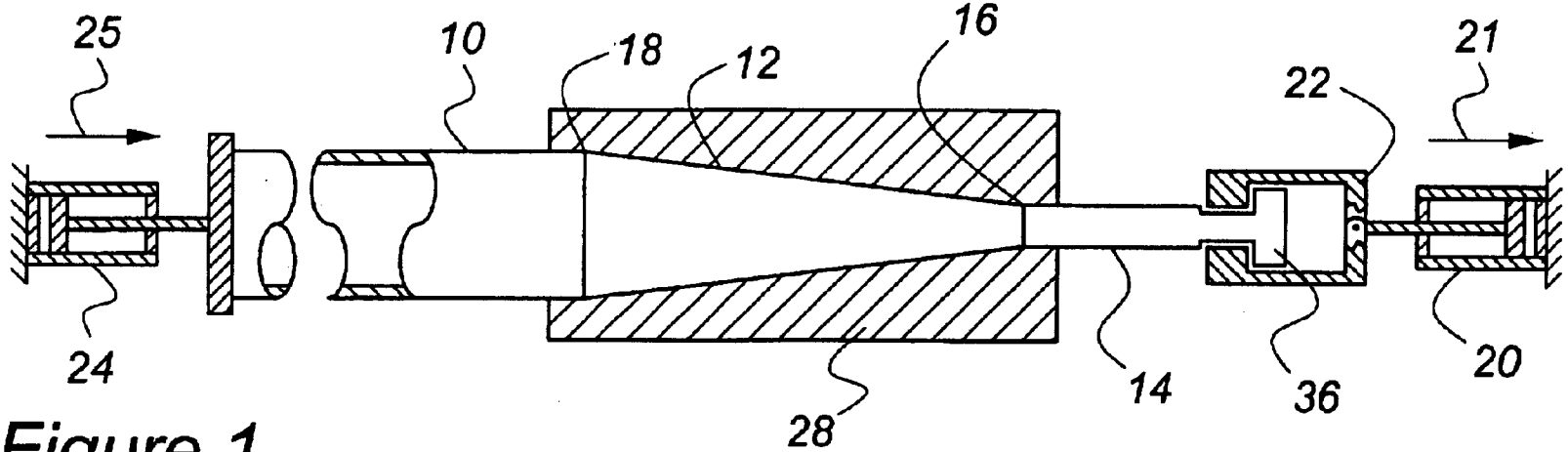
FIG. 1 shows a tube having a long transition section located between a large diameter barrel and a smaller diameter handle.

With reference now to the drawings and particularly to FIG. 1, a workpiece in the original form of a cylindrical tube, preferably of steel, aluminum, or another material capable of elastic or plastic deformation, is arranged in a horizontal plane after having been formed by cold drawing.

Certain tubes produced by the drawing process have the form shown in FIG. 1, in which a relatively large diameter or barrel section 10 is connected by a lengthy transition section 12 to a relatively small diameter handle section 14. It is necessary that the tubes have equal lengths and that smooth blend radii are formed at the intersections 16, 18 where these sections meet. A product formed by this method and having the shape shown in FIG. 1 is an aluminum baseball bat.

To avoid structural failure of the part due to the loads used to pass the workpiece through a reducing die 28 while draw forming the part, the method according to this invention uses a first actuation cylinder 20 to apply a tension force 21 to the handle section 14 of the workpiece 10 on one side of a reducing die 28. Cylinder 20 applies the tension force through a gripper 22 that engages a pull pin 36 secured to the workpiece. A second actuation cylinder 24 applies a compression force 25 to the workpiece at the opposite side of the reducing die 28. Preferably the cylinders 20, 24 are actuated by hydraulic pressure. By adjusting the relative magnitudes of hydraulic pressure in the cylinders, the relative magnitudes of the tension and compression forces are adjusted as required to avoid tensile and compressive failures of the tube while forcing the workpiece through the die. Coordinated use of pulling and pushing cylinders 20, 24 permits a greater reduction in the diameter of the formed tube compared to the diameter of the original workpiece than could be achieved using only a pushing cylinder or a pulling cylinder.

It has been discovered that by applying an accurately controlled, relatively low magnitude tension force to the tube after the tube has been drawn through a reducing die, smooth blend radii at points 16 and 18 can be produced and the final length of the tubes can be made equal. However it is virtually impossible to control with sufficient accuracy that tension force if it is applied by a large capacity actuating cylinder that is used to draw the workpiece through the forming die.

Figure 2:
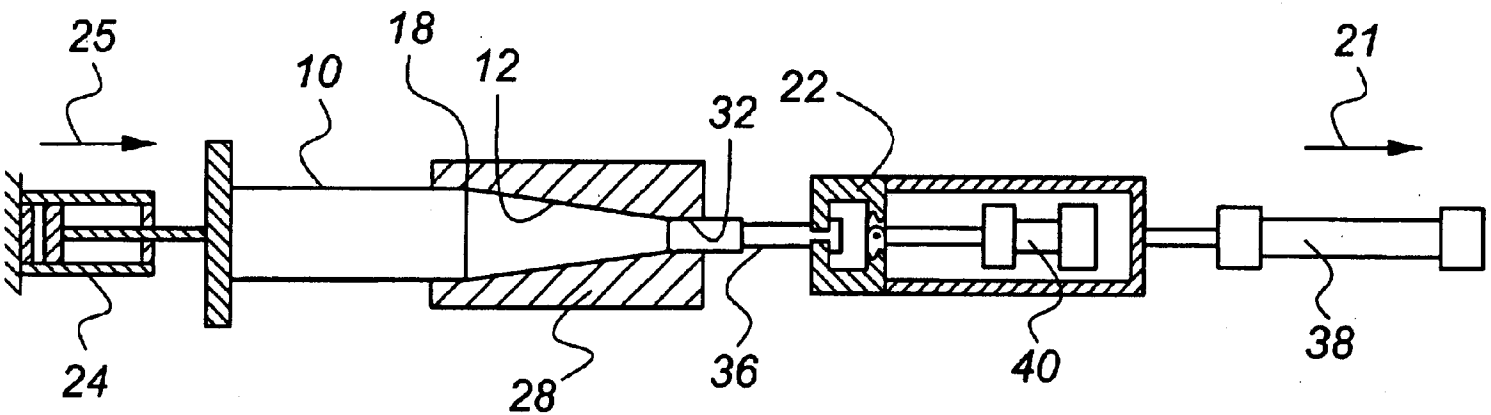
FIG. 2 schematically illustrates equipment for adjusting the tube's final length and producing smooth blend radii on the tube.

Referring now to FIG. 2, the reducing die 28, which reduces the size of the outer contour of the workpiece 10, includes a transition surface 12 for directing the wall of the workpiece radially inward, and a surface 32, in the form of a substantially circular cylinder located at the base of the transition surface 12, for establishing the size of the outside diameter of the small diameter handle portion 14.

To better control the final length of the tube, an additional step of the method is used. In order to apply the large magnitude tension force for drawing the tube and to apply the low magnitude tension force for adjusting the length and producing blend radii, the gripper 22 is engaged with the pull pin 36, which is removeably secured to a diametrically constricted end of the tube, as described with reference to FIG. 3A. The gripper 22 is secured to a relatively large, actuating cylinder 38 having a large tension force capacity for drawing the workpiece through the forming die 28. A second, smaller actuating cylinder 40, having a substantially smaller tension force capacity than that of cylinder 38, applies a load to the gripper after the tube has been drawn through die 28.

In operation, the smaller actuating cylinder 40 is fully extended and inoperative while cylinder 38 applies the force that draws the workpiece through the die and produces the major reduction from the size of the initial workpiece to the size of the formed tube. After the workpiece is rough formed in this way, cylinder 38 is vented and, without interrupting the forming process, cylinder 40 is pressurized to apply a controlled force to the tube end through the pull pin 36. The force produced by cylinder 40 increases the overall length of the formed tube to a predetermined final length.

By precisely increasing the length of the rough formed tube after it is formed in the die, smooth, high quality blend radii at points 16 and 18 result. Use of cylinder 40 improves the formation of acceptable blend radii at the ends of the transition section and precisely controls the final tube length compared to the results attained using the larger cylinder 38 alone, as shown in FIG. 1. Therefore, the scrap rate resulting from the combined use of the large and small actuating cylinders 38, 40 is greatly reduced, and the quality of the resulting tube is improved.

FIGS. 3A–3E show a sequence of steps for forming a tube having a constant outside diameter without the lengthy transition section discussed above. The wall thickness of a tube or hollow shaft 50 formed according to the method of this invention by drawing a tubular workpiece 52 through a reducing die 54 can be varied along the length of the tube by appropriately adjusting the magnitudes of the tension force 21 that pulls the workpiece through the die and the compression force 25 that pushes the workpiece through the die.

Figures 3A, 3B, 3C:
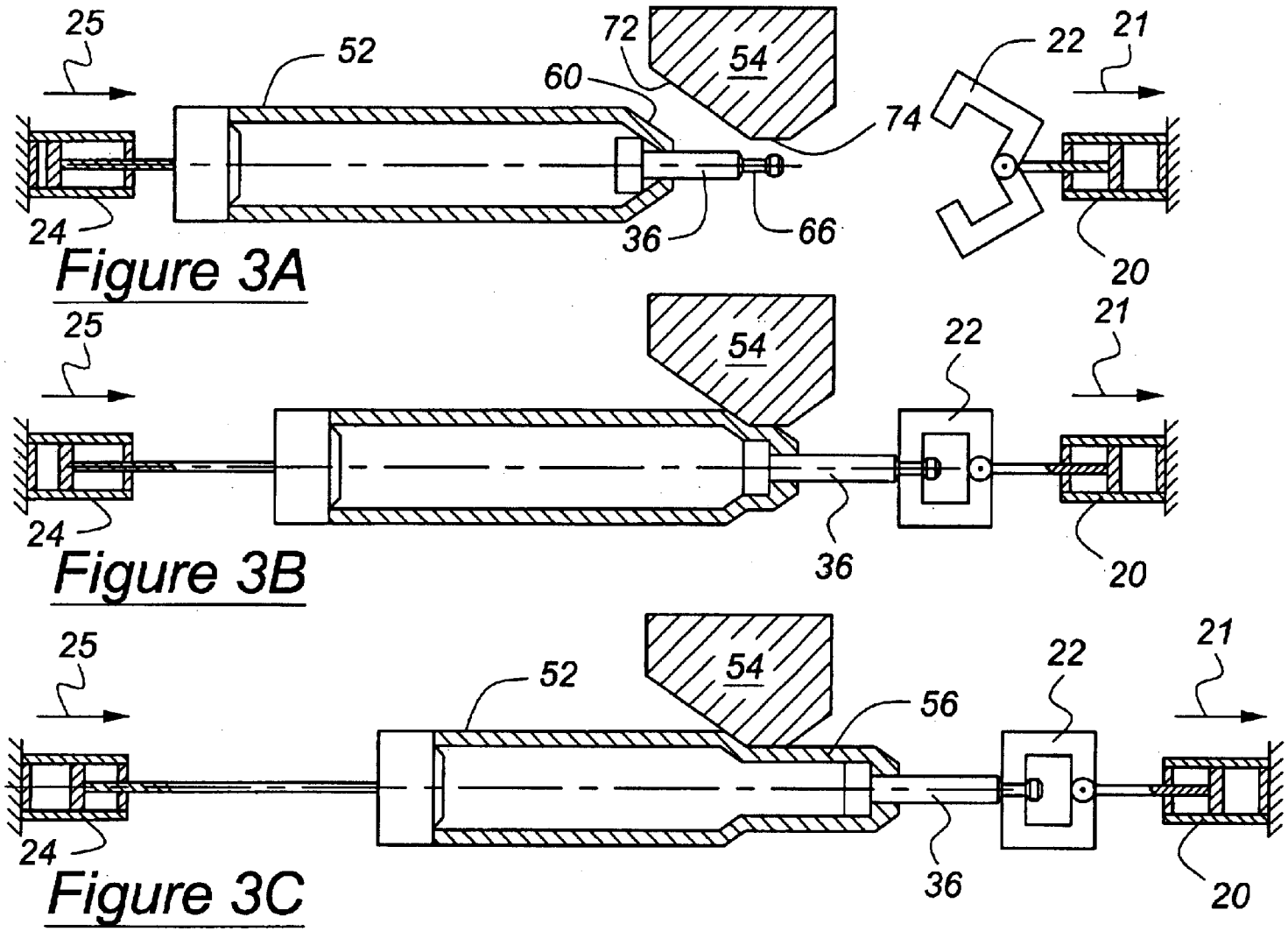
FIGS. 3A-3E show a sequence of steps for draw forming a variable wall thickness tube using a reducing die without a mandrel.
Figure 3D:
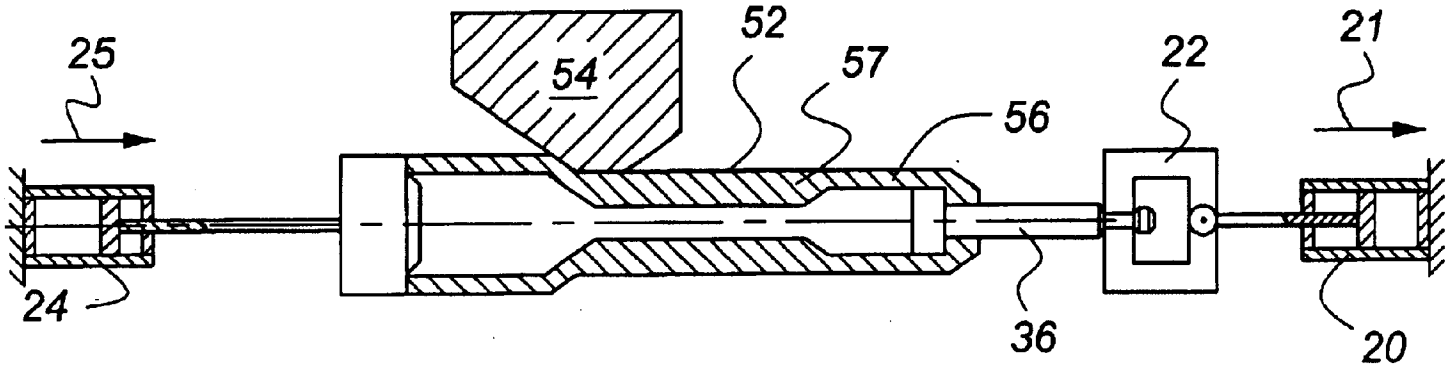
Figure 3E:
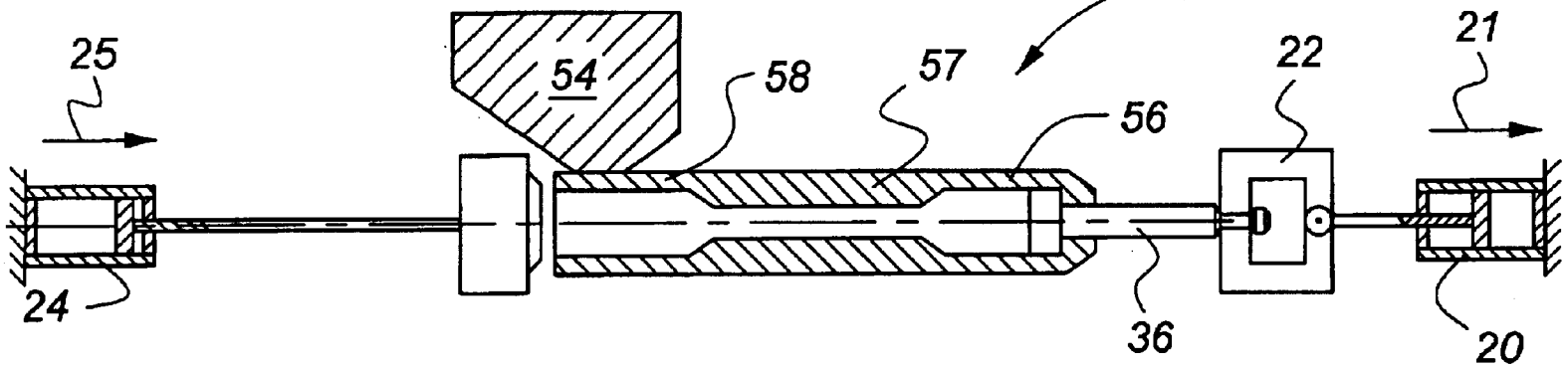

The formed tube 50, shown best in FIG. 3E, includes relatively thin wall length portions 56, 58 axially spaced along the tube length, and a thicker wall portion 57 located between the thin wall portions 56, 58. Yet the tube is formed without a mandrel.

The workpiece 52 has its leading end constricted at 60 such that it cannot pass over the removable pull pin 36 located within the tubular opening at the leading end of the workpiece, as FIG. 3A shows. The process of constricting the tube can be carried out, for example, with a tube pointer such as that shown in U.S. Pat. No. 3,572,080.

The pivoting jaws of the gripper 22 close to engage a recess 66 on the pull pin 36. The first actuation cylinder 20 applies the tension force 21 to the gripper 22 tending to draw the workpiece 52 through the die 54. Located at the trailing end of the workpiece is the second actuating cylinder 24 that applies a compression force 25 to the workpiece tending to push the workpiece 52 through the die 54.

The die is formed with an inclined transition section 72, along which the material of the workpiece is directed radially inward toward a circular cylindrical section 74. As the tube passes through the die, the workpiece extrudes and elongates with its outer diameter being reduced due to the plasticity and ductility of its material.

FIG. 3C illustrates the effect of developing in cylinder 20 and applying to the gripper 22 a tension force 21 that is substantially greater than the force of cylinder 24, which applies a compressive force 25 to the workpiece on the opposite axial side of the die tending to push the workpiece through the die. For example, the force of cylinder 20 may be about 95 percent of the sum of the forces produced by both actuating cylinders 20 and 24; the force of cylinder 24 is about 5 percent of the sum of the forces produced by both actuating cylinders. In that instance, the resulting wall thickness of the tube length portion 56 is relatively thin.

FIG. 3D illustrates the effect of developing in cylinder 20 and applying to gripper 22 a tension force 21 that is substantially less than the compression force 25 produced by cylinder 24. For example, the force of cylinder 20 is about 5 to 10 percent of the sum of the forces produced by both actuating cylinders, and the force of cylinder 24 is about 90–95 percent of the sum of the forces produced by both actuating cylinders. In that instance, the wall thickness of the tube length portion 57 is relatively thick. The tube is kept straight due to the pulling effect of the tension force 21.

In the next step the wall thickness is reduced from that of FIG. 3D. FIG. 3E shows the effect of again developing in cylinder 20 and applying to the gripper 22 a tension force 21 substantially greater than the force of cylinder 24. The force of cylinder 20 is about 95 percent of the sum of the forces produced by both cylinders, and the force of cylinder 24 is about 5 percent of the sum of the forces produced by the actuating cylinders. In that instance, the wall thickness of the tube length portion 58 is thin relatively to that of portion 57.

The linear changes in wall thickness in the transitions between the thick wall portion 57 and thin wall portions 56, 58 result by continually changing at a linear rate the magnitudes of the tension and compression forces 21, 25 while the workpiece is moving through the die.

Next, the removable plug or pull pin 36 is dropped out of the left end of the tube. The final configuration shown in FIG. 3E is a tube having a constant outside diameter and an inside diameter, which is larger at opposite ends of the tube than at the tube's mid-portion. Finally, the constricted portion 60 of the workpiece can be cut off.

The following results were produced by the method of the invention described with reference to FIGS. 3A-3E when applied to a tubular workpiece of AISI 15B21 Boron enhanced steel alloy and having the following properties and dimensions: Rb hardness 80, initial wall thickness 0.150 inches, initial outside diameter 1.875 inches, diameter at the throat of the reducing die 1.414 inches, and ambient room temperature.

EXAMPLE 1

Pull force 21 of cylinder 20: 50,000 pounds

Push force 25 of cylinder 24: 5,000 pound

Speed of drawing the workpiece through the die: 3 to 5 inches per second

Final outside diameter of tube: 1.414 inches

Wall thickness of tube: 0.150 inches

EXAMPLE 2

Pull force 21 of cylinder 20: 5,000 pounds

Push force 25 of cylinder 24: 60,000 pounds

Speed of drawing the workpiece through the die: 3 to 5 inches per second

Final outside diameter of tube: 1.414 inches

Wall thickness of tube: 0.187 inches

Although the location of the thick wall length portion 57 of the tube shown in FIG. 3E is between the thin walled portions 56, 58, the wall thickness can vary continually along the length, or a thin wall portion can be located between thick walled portions, or any combination of these can be produced by the method of this invention. These variations in size and relative axial position of the wall thickness are produced remarkably without use of an internal mandrel.

The cross section of the finished tube need not be circular. For example, the reducing die may have an elliptical or oval cross section, and the cross section of the tube formed by the method of this invention will also be elliptical or oval. In this way, the structural properties of an intrusion beam can be further improved over a circular tube of constant wall thickness by providing, in the region where the loads and stresses of the beam are greatest, both the larger bending moment of inertia inherent in an oval cross section and a larger wall thickness.

Therefore, the inner surface of the workpiece need not be cleaned, flushed, lubricated or in any other way prepared before draw forming using this invention. The inner surface of rolled workpieces having a weld seam and scarf material require no more preparation than does the inner surface of a seamless workpiece.

Although the invention has been shown in connection with certain specific embodiments, it will be readily apparent to those skilled in the art that various changes in form and arrangement of parts and method steps may be made to suit requirements without departing from the spirit and scope of the invention.

Therefore, what is claimed is:

1. A method for forming from a tubular workpiece a tube having a wall thickness that varies along its length, comprising the steps of:

positioning relative to the workpiece a reducing die for reducing the outer diameter of the workpiece and establishing the outside diameter of the formed tube;

advancing the workpiece through the die by applying to the workpiece a pulling force at a first location and a pushing force at a second location, the first and second locations being on opposite axial sides of the die; and changing the wall thickness of the tube as the workpiece advances through the die by changing the relative magnitudes of the pushing force and pulling force.

2. The method of claim 1, wherein the step of changing the wall thickness further comprises:

applying to the workpiece at the first location a force whose magnitude is in the range of 5–10 percent of the sum of the forces applied to the workpiece at the first location and second location.

3. The method of claim 1, wherein the step of changing the wall thickness further comprises:

applying to the workpiece at the first location a force whose magnitude is in the range of 90–95 percent of the sum of the forces applied to the workpiece at the first location and second location.

4. The method of claim 1, wherein the step of changing the wall thickness further comprises:

continually changing the wall thickness of the tube by continually changing the relative magnitudes of the pushing force and pulling force as the workpiece advances through the reducing die.

5. The method of claim 1, wherein the step of changing the wall thickness further comprises:

increasing and decreasing the wall thickness of the tube by occasionally changing the relative magnitudes of the pushing force and pulling force as the workpiece advances through the reducing die.

6. The method of claim 1, wherein the step of changing the wall thickness further comprises:

increasing the wall thickness of the tube by increasing the relative magnitude of the pushing force relative to the magnitude of the pulling force as the workpiece advances through the reducing die.

7. The method of claim 1, wherein the step of changing the wall thickness further comprises:

decreasing the wall thickness of the tube by increasing the relative magnitude of the pulling force relative to the magnitude of the pushing force as the workpiece advances through the reducing die.

8. The method of claim 1, further comprising the steps of:

connecting to the workpiece a first actuating cylinder having a relatively large force capacity, and a second actuating cylinder having a smaller force capacity;

actuating the first actuating cylinder to pull the workpiece through the reducing die with a relatively large force; deactivating the first actuating cylinder; and actuating the second actuating cylinder to pull the workpiece with a smaller force than the force of the first actuating cylinder.

9. The method of claim 8, wherein during the pulling step the axial length of the workpiece is increased by a force produced by the second actuating cylinder.

10. Apparatus for forming from a tubular workpiece a tube having a wall thickness that varies along the length of the tube, comprising:

a reducing die for reducing the outer diameter of workpiece and contouring the outer surface of the tube being formed;

a first actuating cylinder for producing a pulling force having a magnitude applied to the workpiece at a first location and tending to advance the workpiece through the die; and a second actuating cylinder for producing a pushing force having a magnitude that is independent of the magnitude of the pulling force, the pushing force being applied to the workpiece at a second location and tending to advance the workpiece through the die, the first and second locations being located on opposite axial sides of the die; and whereas by changing the magnitude of the pushing force or pulling force the wall thickness of the tube is changed without use of an internal mandrel as the workpiece is advanced through the die.

11. The apparatus of claim 10, wherein the reducing die has an inner surface formed with a transition section having a conical surface extending between a large diameter end and a small diameter end, and a uniform section having a first substantially cylindrical surface having one end located at the small diameter end and extending axially therefrom.

12. The apparatus of claim 10, wherein the reducing die has an inner surface having an elliptical cross section.

13. The apparatus of claim 10, wherein the reducing die has an inner surface having a circular cross section.

14. The apparatus of claim 10, wherein the reducing die has an inner surface having an oval cross section.

15. The apparatus of claim 10, further comprising:

a pull pin adapted to engage the workpiece, wherein the first actuating cylinder applies to the workpiece through the pull pin a force tending to move the workpiece axially through the die.

16. The apparatus of claim 10, further comprising:

a pull pin adapted to engage the workpiece;

a puller adapted to engage and disengage the pull pin;

a third actuating cylinder connected to the puller, having a smaller force capacity than that of the first actuating cylinder, and adapted to apply to the workpiece through the puller and pull pin a force tending to increase the length of the tube after the tube has passed through the reducing die; and wherein the first actuating cylinder applies to the workpiece through the pull pin and puller a force tending to move the workpiece axially through the reducing die.

17. A method for forming from a tubular workpiece a tube having a wall thickness that varies continually along at least a portion of the length of the tube, comprising the steps of:

positioning relative to the workpiece a reducing die for reducing the outer diameter of the workpiece and establishing the outside diameter of the formed tube;

connecting to the workpiece a first actuating cylinder for advancing the workpiece through the die by applying to the workpiece a pulling force at a first location;

connecting to the workpiece a second actuating cylinder for advancing the workpiece through the die by applying to the workpiece a pushing force at a second location, the first and second locations being on opposite axial sides of the die; and changing the wall thickness of the tube by changing the relative magnitudes of the pushing force and pulling force produced by the first and second actuating cylinders as the workpiece advances through the die.

18. The method of claim 17, wherein the step of changing the wall thickness further comprises:

continually changing the wall thickness of the tube as the workpiece advances through the reducing die by continually changing the relative magnitudes of the pushing force and pulling force produced by the first and second actuating cylinders.

19. The method of claim 17, wherein the step of changing the wall thickness further comprises:

increasing and decreasing the wall thickness of the tube as the workpiece advances through the reducing die by occasionally changing the relative magnitudes of the pushing force and pulling force produced by the first and second actuating cylinders.

20. The method of claim 17, wherein the step of changing the wall thickness further comprises:

increasing the wall thickness of the tube as the workpiece advances through the reducing die by increasing the relative magnitude of the pushing force relative to the magnitude of the pulling force produced by the first and second actuating cylinders.

21. The method of claim 17, wherein the step of changing the wall thickness further comprises:

decreasing the wall thickness of the tube as the workpiece advances through the reducing die by increasing the relative magnitude of the pulling force relative to the magnitude of the pushing force produced by the first and second actuating cylinders.

* * * * *